US011047184B2

(12) United States Patent
Gu et al.

(10) Patent No.: US 11,047,184 B2
(45) Date of Patent: Jun. 29, 2021

(54) DOWNHOLE CUTTING TOOL AND ANCHOR ARRANGEMENT

(71) Applicant: Halliburton Energy Services, Inc., Houston, TX (US)

(72) Inventors: Yan Gu, Aberdeenshire (GB); Robin Porter, Aberdeen (GB)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 16/546,981

(22) Filed: Aug. 21, 2019

(65) Prior Publication Data

US 2020/0063512 A1 Feb. 27, 2020

(30) Foreign Application Priority Data

Aug. 24, 2018 (GB) ..... 1813865

(51) Int. Cl.
*E21B 29/06* (2006.01)
*E21B 23/01* (2006.01)
*E21B 29/00* (2006.01)

(52) U.S. Cl.
CPC ..... *E21B 23/01* (2013.01); *E21B 29/005* (2013.01); *E21B 29/06* (2013.01)

(58) Field of Classification Search
CPC ..... E21B 29/06; E21B 29/005
See application file for complete search history.

(56) References Cited

U.S. PATENT DOCUMENTS 2,117,050 A 5/1938 Wilson
3,273,645 A * 9/1966 Der Mott ..... E21B 23/04 166/55.1
3,289,691 A 12/1966 Kennard
3,433,252 A 3/1969 Kennard
5,479,988 A 1/1996 Appleton
5,823,255 A 10/1998 Swiatowy et al.
6,189,629 B1 * 2/2001 McLeod ..... E21B 7/061 175/321
6,772,839 B1 8/2004 Bond
6,868,901 B2 3/2005 Mason et al.
6,915,853 B2 7/2005 Bakke et al.
7,370,703 B2 5/2008 Hill et al.
7,373,994 B2 5/2008 Tchakarov et al.
7,562,700 B2 7/2009 Lewis et al.
7,575,056 B2 8/2009 Fuhst et al.
(Continued)

FOREIGN PATENT DOCUMENTS

GB 2129350 5/1984
WO 2010066276 6/2010

OTHER PUBLICATIONS

GB1911979.1 , "Combined Search and Examination Report", dated Feb. 5, 2020, 5 pages.

*Primary Examiner* — Cathleen R Hutchins

(74) *Attorney, Agent, or Firm* — Kilpatrick Townsend & Stockton LLP

(57) ABSTRACT

A downhole cutting tool is operable, when deployed, to create a cut through a wall of a tubular member, for example a downhole casing, tubing or drill pipe. The downhole cutting tool comprises a tool head assembly, comprising a tubular body, which provides a housing, which houses a cutting member, a first anchor located downstream of the cutting member and a second anchor member located upstream of the cutting member.

15 Claims, 3 Drawing Sheets

(56) References Cited

U.S. PATENT DOCUMENTS

| | | | |
|---|---|---|---|
| 8,454,325 | B2 | 6/2013 | Fisher et al. |
| 8,528,630 | B2 | 9/2013 | Tunget |
| 8,887,835 | B2 | 11/2014 | Kosovich |
| 8,893,827 | B2 | 11/2014 | Kosovich |
| 9,097,109 | B2 | 8/2015 | Boekholtz et al. |
| 9,103,088 | B2 | 8/2015 | Clark, II et al. |
| 9,115,710 | B2 | 8/2015 | Mcnichol et al. |
| 9,261,091 | B2 | 2/2016 | Fisher et al. |
| 9,371,704 | B2 | 6/2016 | Boekholtz et al. |
| 9,631,337 | B2 | 4/2017 | Clark, II et al. |
| 9,759,047 | B2 | 9/2017 | Benson et al. |
| 9,849,525 | B2 | 12/2017 | Pierce et al. |
| 9,850,724 | B2 | 12/2017 | Foucher et al. |
| 9,901,997 | B2 | 2/2018 | Pierce et al. |
| 2012/0234542 | A1 | 9/2012 | Mcfall |
| 2016/0130904 | A1 | 5/2016 | Andersen |
| 2016/0215580 | A1 | 7/2016 | Lehr |
| 2016/0251924 | A1 | 9/2016 | Porter |
| 2016/0251925 | A1 | 9/2016 | Porter |

* cited by examiner

DOWNHOLE CUTTING TOOL AND ANCHOR ARRANGEMENT

CROSS REFERENCE TO RELATED APPLICATIONS

This is related to and claims priority benefits from Great Britain Provisional Patent Application No. GB1813865.1, filed on Aug. 24, 2019, and titled "Downhole Cutting Tool and Anchor Arrangement," which is hereby incorporated herein in its entirety by this reference.

TECHNICAL FIELD

The present disclosure relates to a downhole cutting tool, in particular a punching tool operable to create holes through a downhole tubular component, for example casing, tubing or drill pipe. In particular, the present disclosure relates to an improved anchoring arrangement associated with a punching tool

BACKGROUND

Tools for cutting downhole tubular component, for example casing, tubing or drill pipe are typically deployed on the end of wireline, drill pipe, coiled tubing or other tubular.

Typically, punching and cutting tools are located towards the end of a tool string, which is deployed within the casing, tubing or drill pipe to perform a cut from inside to outside. It will be appreciated that the components used to perform the cutting action are typically contained within a tubular casing/housing from within which the punch or cutter extend to perform the punching or cutting action. In addition to the punch or cutter being contained within the housing one or more anchor mechanisms are also contained within the housing until the tool reaches the depth at which the cutting or punching action is to be performed.

Typically, downhole mechanical cutting and punching tools utilise at least one anchor mechanism positioned as close to the punch or cutter as possible to reduce displacement of the tool head, which contains the cutter or punch, such that accuracy of the cut is maximised.

SUMMARY

Some examples of the present disclosure provides a downhole cutting tool operable, when deployed, to create a cut through a wall of a tubular member, the cutting tool comprises: a tool head assembly, comprising a tubular body providing a housing, which houses a cutting member, a first stabilizing anchor located downstream of the cutting member and a second stabilizing anchor upstream of the cutting member.

In conventional downhole cutting tools all anchoring members are located upstream of the cutting member and the cutting member is located downstream of the anchors and generally towards the end of the tool head. This arrangement means the cutting member, for example a punch tool, cutting disc, etc., is located on a free end of the tool head. As such when the cutter is advanced for cutting and makes contact with the tubular wall the end of the tool head is subject to bending forces, which may misalign the cutter, may add additional load to the tool and may cause unwanted vibration when performing the cutting action. It will be appreciated, by providing an anchor member downstream of the cutting member the bending forces, flexing of the cutting member and vibration of the cutting member is at least reduced. Additionally, in the example where a severing cutting member is used, for example a cutter that cuts through the entire circumference of the tubular, the downstream and upstream anchors maintain the position of the resulting two pieces of tubular until the cut is complete and the anchors are released.

The downhole cutting tool may further comprise an actuating mechanism operable to control simultaneous activation and deactivation of the first and second anchors.

The downhole cutting tool may further comprise a locating anchor and a second actuating mechanism, wherein the locating anchor is located upstream of the first stabilizing anchor, the second stabilizing anchor and the cutting member, wherein the second actuating mechanism is operable to actuate the locating anchor independently of the first stabilizing anchor and the second stabilizing anchor.

The downhole tool may comprise at least an upper section and a lower section, wherein the locating anchor is housed in the upper section and wherein the first stabilizing anchor, the second stabilizing anchor and the cutting member are housed in the lower section The lower section may be rotationally connected to the upper section, wherein the lower section and the upper section include a common longitudinal axis and the lower section rotates relative to a stationary upper section about the common longitudinal axis.

Rotation of the lower section facilitates adjusting the angular position of the cutting member relative to the wall to be cut.

The cutting member may comprise a hole cutter. The hole cutter may comprise an annular cutter, which creates a circular cut through the wall and produces a cylinder of waste material when the cutter breaks through the wall. Alternatively, the cutting member may comprise a fluted drill bit.

In one example, a method includes:

deploying a cutting tool downhole in an inner area defined by a tubular member, the cutting tool comprising a tubular body providing a housing that houses a cutting member, a first stabilizing anchor downstream of the cutting member, a second stabilizing anchor upstream of the cutting member, and a locating anchor;

extending the locating anchor to maintain the cutting tool at a desired depth within the tubular member and to prevent vertical displacement of the cutting tool with respect to the tubular member;

extending the first stabilizing anchor and the second stabilizing anchor to maintain an angular position of the cutting member with respect to the tubular member; and cutting the tubular member by extending the cutting member to the tubular member.

DETAILED DESCRIPTION

Figure 1:
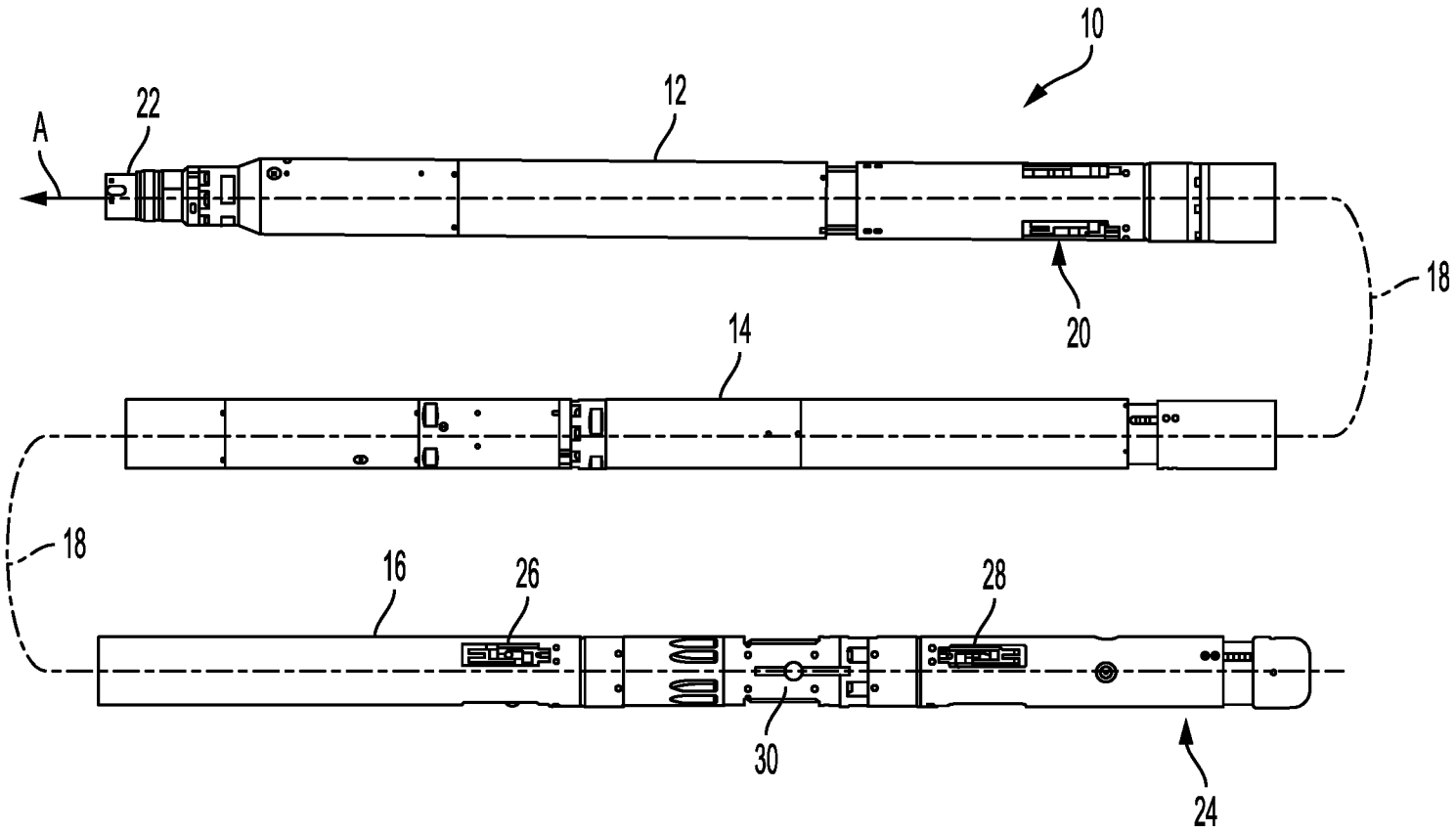
FIG. 1 illustrates a downhole punch tool according to an embodiment of the present disclosure.
Figure 2:
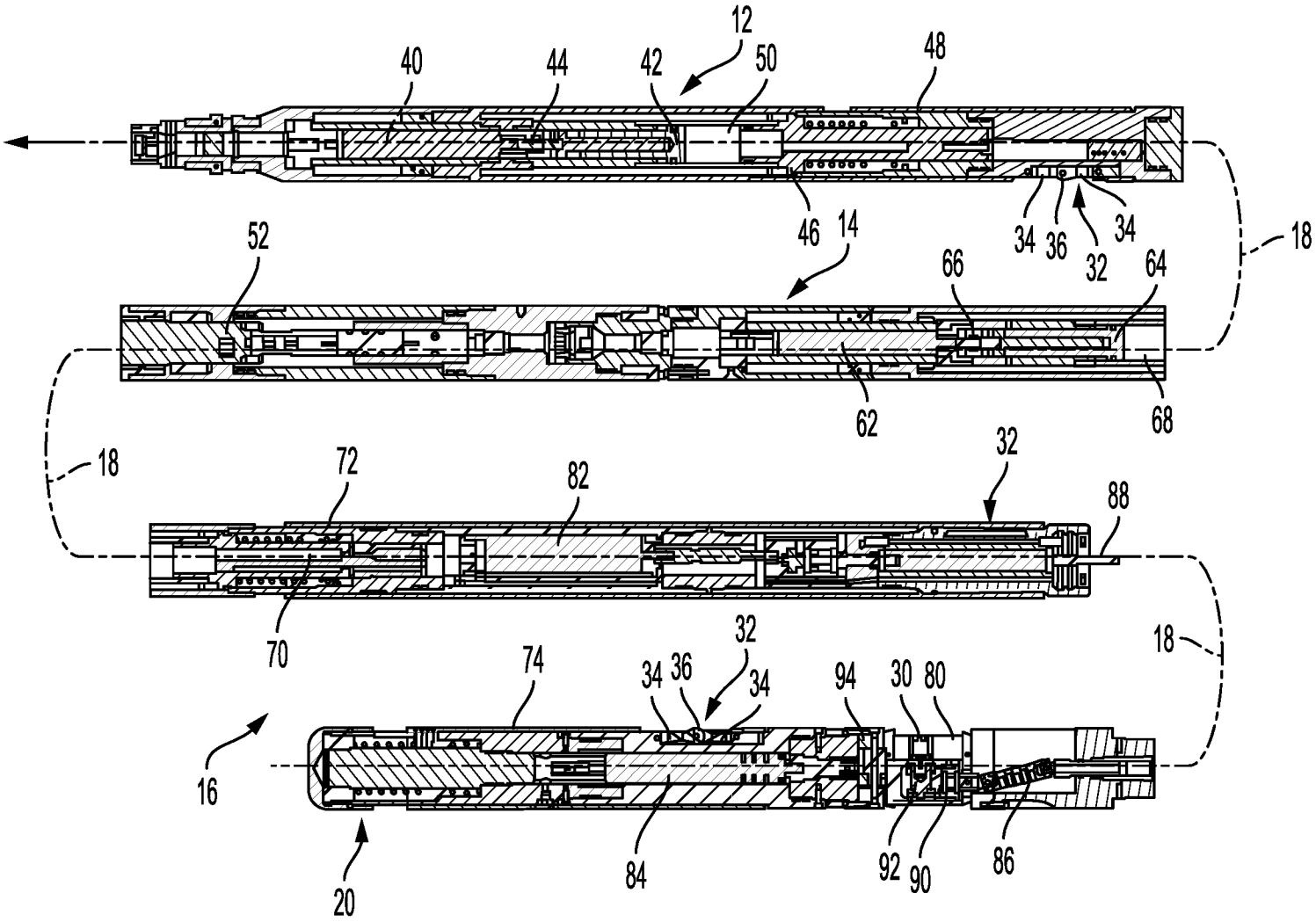
FIG. 2 illustrates a cross-sectional view about the axial centreline of the downhole punch tool illustrated in FIG. 1.
Figure 3:
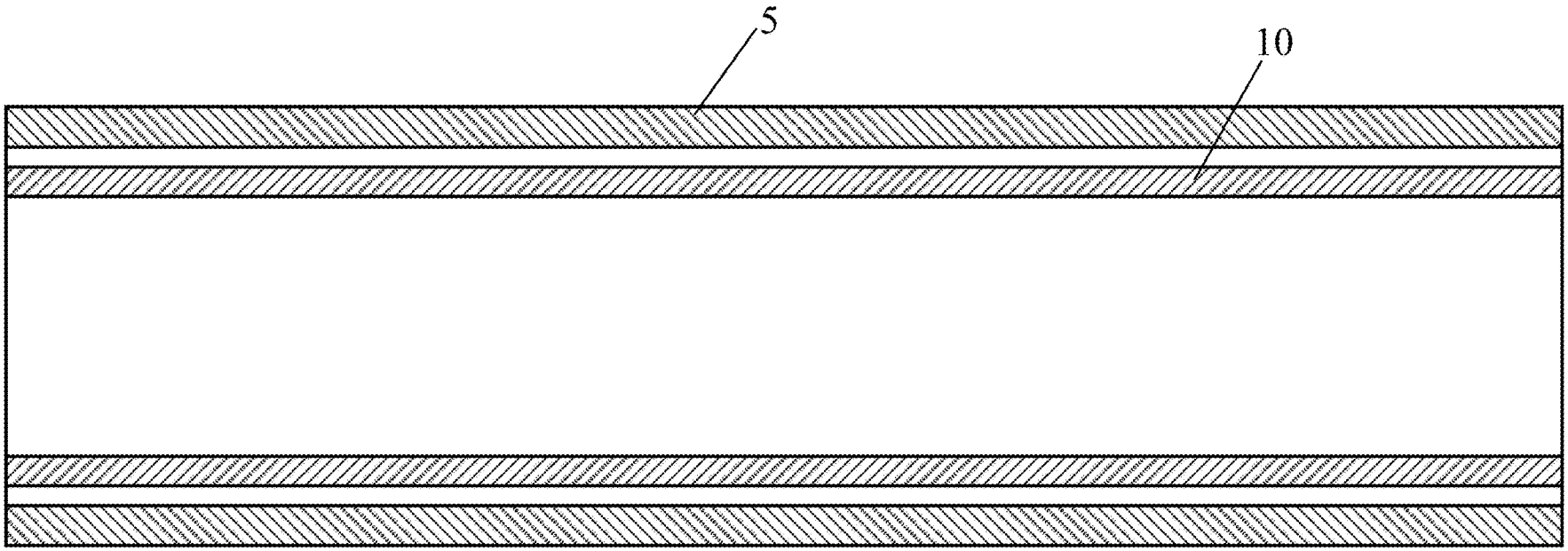
FIG. 3 illustrates a cross-sectional view of the downhole punch tool of FIG. 1 positioned within a tubular member.

An example of a downhole punch tool 10 is illustrated in FIGS. 1 and 2 and 3. The downhole punch tool 10 is suitable for producing one or more holes through a downhole casing, tubing (e.g. tubing member 5 as depicted in FIG. 3), drill pipe etc. in which the punch tool 10 is deployed.

For ease of representation the tool 10 is illustrated as three portions in FIG. 1 i.e. an upper portion 12, a middle portion 14 and a lower portion 16. In FIG. 2, the lower portion 16 is further divided in two, thereby providing a more detailed view of the internal components of the lower portion 16. The dotted line 18 in FIGS. 1 and 2 represents the assembled arrangement, where the adjoining sections of each portion 12, 14, 16 are connected by the dotted line.

It will be appreciated, with reference to FIG. 2, that each portion 12, 14, 16 includes an assembly of multiple tubular elements/sleeves to form the overall structure of the punch tool 10. Functionally, the upper portion 12, the middle portion 14 and the lower portion 16 each have a role to play during operation of the punch tool 10; these roles and the components facilitating the roles are described further below with reference to the internal and external elements of each portion 12, 14, 16.

When assembled, the upper portion 12 connects the punch tool 10 to an electronic control section of a tool string (not illustrated), which facilitates deployment of the punch tool 10 into the casing, tubing, drill string etc. in a conventional manner.

Connection of the punch tool 10 to the tool string is via a mechanical and electronic connection 22 located at the top of the upper portion 12; connection of the upper portion 12 to the tool string (not illustrated) is in the direction indicated by arrow A.

The upper portion 12 houses a locating anchor 20, which (as described further below) is extendable and retractable for deployment in, and recovery from, a casing, tubing, drill string etc. in which the punch tool 10 is deployed.

The locating anchor 20 facilitates fixing the punch tool 10 at a desired depth within the casing, tubing, drill pipe etc., whilst allowing subsequent adjustment of the angular position of the middle portion 14 and lower portion 16 relative to the casing, tubing, drill pipe etc. This means the hole cutter 30 (described further below) of the punch tool 10 can be located at the correct depth and in the correct angular position before a hole cutting action is performed.

The middle portion 14 is connected at one end to the upper portion 12 and at the opposite end to the lower portion 16. The connection of the middle portion 14 to the upper portion 14 is such that the middle portion 14 can rotate relative to the fixed upper portion 12 i.e. when the locating anchor 20 is extended.

The lower portion 16 is rotationally fixed to the middle portion 14, such that both the middle portion 14 and the lower portion 16 rotate as a unit relative to the upper portion 12 when the locating anchor 20 is extended and engaged with the inner surface of the casing, tubing or drill pipe etc. in which the punch tool 10 is deployed.

Rotation of the middle portion 14 and the lower portion 16 allow adjustment of the angular position of the punch tool 10 such that the middle portion 14 and the lower portion 16 can be correctly oriented at a fixed depth relative to the inner surface to be cut.

The lower portion 16 defines a tool head assembly 25, which includes the tool head 24 of the punch tool 10 and a tubular body 27, which houses two stabilising anchors 26, 28 and a hole cutter 30 (see FIGS. 1 and 2).

Relative to the direction of deployment, the two stabilising anchors 26, 28 are arranged such that one anchor 26 is located below (upstream) the hole cutter 30 and the other anchor 28 is located above (downstream) the hole cutter 30.

When deploying the punch tool 10 in a casing, tubing or drill pipe etc. the punch tool 10 is lowered into the casing, tubing, drill pipe etc. to a desired depth before deploying the locating anchor 20, which fixes the punch tool 10 against further vertical displacement downhole. Once the depth is fixed, rotation of the middle portion 14 and lower portion 16 can be activated to adjust the position of the hole cutter 30 relative to the surface of the casing, tubing, drill pipe etc. in which the punch tool 10 is deployed.

When the hole cutter 30 is oriented at the desired angular position the stabilising anchors 26, 28 can be extended simultaneously to secure the anchors 26, 28 against the surface of the casing, tubing, drill pipe etc. in which the punch tool 10 is deployed.

After activating the anchors 26, 28 the hole cutter 30 can be actuated and extended relative to the lower portion 16 such that a hole can be cut through the wall of the casing, tubing, drill pipe etc.

When the cutting/punching operation is complete the hole cutter 30 can be retracted into the lower portion 16. At this point the stabilising anchors 26, 28 can be released/retracted and the angular position of the hole cutter 30 can be adjusted if more than one hole is required at the same depth. Again, rotation of the middle portion 14 and lower portion 16 adjusts the angular position of the hole cutter 30 to the next desired angular position, at which point the stabilising anchors 26, 28 can be deployed to secure the hole cutter 30 in the desired angular position before the hole cutter 30 is activated. This process can be repeated at various angular positions by releasing the anchors 26, 28 before rotating the middle and lower portions 14, 16 to a desired angular position.

It will be appreciated that the vertical position of the hole cutter 30 can be adjusted between cuts, i.e. by releasing all three anchors 20, 26, 28 and raising or lowering the punch tool 10 to a different position. Again, when the hole cutter 30 is located at the desired vertical position the locating anchor 20 can be activated to fix the upper portion 12, thereby allowing rotation of the middle and lower portions 14, 16 to the desired angular position of the hole cutter 30.

Referring to FIGS. 1 and 2, the locating anchor 20 and the stabilising anchors 26, 28 each include three circumferentially spaced anchor elements 32. Each anchor element 32 includes two link arms 34, which are joined together at an elbow 36 and pivotally connected at the opposite ends to a sleeve within the portion 14, 16, housing the anchors 20, 26, 28.

The elbow 36 of each anchor element 32 is operable, when deployed to press against the internal surface of the casing, tubing, drill pipe etc. in which the punch tool 10 is deployed. In the illustrated example, three anchor elements 32 are used to ensure the punch tool 10 is centralised and stable.

In the illustrated example (see FIG. 2, upper portion 12), the elbow 36 of the locating anchor 20 is defined by a serrated disc such that, when deployed, there is a degree of 'bite' to avoid slippage during adjustment of the angular position of the hole cutter 30 as described above.

It will be appreciated that the force of the elbows 36 being pressed against the inside of the casing, tubing, drill pipe etc. provides an anchoring force. In the event there is corrosion or degradation within the casing, tubing, drill pipe etc. the serrations are expected to apply a deforming action i.e. bite into the surface. As such, a serrated element may enhance the function of the anchor 20, 26, 28 in the contact area.

Visible in FIG. 2 are the internal components operable to control deployment of the anchors 20, 26, 28, adjustment of the angular position of the hole cutter 30 and operation of the hole cutter 30.

The upper portion 12 houses the locating anchor 20, as described above, an electric motor 40 connected to a motor drive piston 42 via a gear system 44, an anchor actuating piston 46 and an actuating sleeve 48. At least one end of each link arm 34 of the locating anchor 20 is pivotally connected to the actuating sleeve 48 such that actuation of the motor 40 drives the motor piston 42 via the gear system 44.

Driving the motor piston 24 displaces fluid from a fluid chamber 50 below the piston 42, which displaces the anchor actuating piston 46, which in turn displaces the actuating sleeve 48 downwards (to the right in FIG. 2), which actuates/extends the locating anchor 20 to fix the punch tool 10 in the desired vertical location.

After extending the locating anchor 20, if necessary, a primary function/role of the middle portion 14 can be actuated, where the middle portion 14 and lower portion 16 rotate as a unit to adjust the angular position of the hole cutter 30. The middle portion 14 houses a gear system 52 towards the top of the middle portion (to the left of FIG. 2). When actuated, the gear system 52 facilitates rotation of the middle and lower portions 14, 16. Rotation of the middle and lower portions is facilitated by a motor 35, which is situated proximate the locating anchor 20. In the illustrated example the motor 35 is located just above (to the left in FIG. 2) of the locating anchor 20.

The lower section (to the right of FIG. 2) of the middle portion 14 houses components operable to actuate the stabilising anchors 26, 28. In addition, the lower section (to the left of FIG. 2) of the tool head 24 includes a sleeve 60, which moves to actuate the lower stabilising anchor 28 (leftmost anchor in FIG. 2).

The stabilising anchors 26, 28 are deployed in a similar manner to the locating anchor 20, as described above. However, both stabilising anchors 26, 28 are deployed/actuated simultaneously. Therefore, a single motor 62 (housed in the middle portion 14) actuates a drive piston 64 via a gear system 66 to displace fluid 68, which moves an actuating piston 70 and a sleeve 72 connected thereto. The sleeve 72 is connected to the upper stabilising anchor 26 and to a further sleeve 74, which is connected to the lower stabilising anchor 28, such that displacement of the upper sleeve 72 causes simultaneous displacement of the lower sleeve 74 such that both stabilising anchors 26, 28 are actuated simultaneously. A flow path (not visible) associated with deploying the stabilising anchors 26, 28 is provided from the motor 62, down via the piston 64, through the tool body to a piston 65 located in the tool head 24. When activated, the fluid flow drives the piston 65 downwards (to the left in FIG. 2), which facilitates movement of sleeve 74, which simultaneously activate the stabilising anchors 26, 28. A spring 75, located around the piston 65, is provided for return/retraction of the stabilising anchors 26, 28, when fluid pressure is removed.

The lower portion 16 houses the drive system for the hole cutter 30 i.e. the drive system operable to rotate the hole cutter 30 and the independent drive system operable to radially extend and retract the hole cutter 30 during and after the cutting operation is complete.

In the illustrated example the hole cutter 30 is provided by an annular cutter, which creates a circular cut and produces a cylinder (a core) of waste material as the cutter 30 rotates and advances through the wall of the casing, tubing or drill pipe in which the punch tool 10 is deployed. When the hole cutter 30 breaks through, a circular hole remains in the wall.

The hole cutter 30 is mounted in a carriage 80, which is located towards the tool head 24 in the lower portion 16 of the punch tool 10 and between the two stabilising anchors 26, 28. By providing a stabilising anchor 26, 28 above and below the hole cutter 30 the effect of bending forces and vibration on the hole cutter 30 is improved compared with conventional tools, where anchors are only located above the cutter.

In the illustrated example, two electric motors 82, 84 are provided in the lower portion 16 to drive the hole cutter 30. The first motor 82 is used to control rotation of the hole cutter 30 and the second motor 84 is used to control radial advancement and retraction of the hole cutter 30. The first motor 82 is coupled to a universal joint 86 via a drive shaft 88 and twin bevel gears 90, 92, which engage to rotate the hole cutter 30.

The second motor 84 is located below (upstream of) the hole cutter 30 and is connected with a feed drive gear system 94, which is connected to the carriage 80, in which the hole cutter 30 is mounted.

The carriage 80 slides to advance and retract the hole cutter 30. A dovetail connection (not visible) ensures control of the linear displacement of the carriage 80 and therefore the hole cutter 30.

Whilst specific embodiments of the present disclosure have been described above, it will be appreciated that departures from the described examples may still fall within the scope of the present disclosure.

What is claimed is:

1. A downhole cutting tool operable, when deployed, to create a cut through a wall of a tubular member, the cutting tool comprises:

a tool head assembly comprising:

a first tubular body providing a first housing and including a first locating anchor, a second tubular body providing a second housing; and a third tubular body providing a third housing which includes a cutting member, a first stabilizing anchor located downstream of the cutting member and a second stabilizing anchor upstream of the cutting member, wherein the second tubular and third tubular are rotationally fixed relative to one another when the first locating anchor is engaged with an inner surface of the wall of the tubular member, and wherein the second tubular body may rotate relative to the first tubular body when first locating anchor is engaged with the inner surface of the wall of the tubular member.

2. A downhole cutting tool as claimed in claim 1, wherein the second tubular body further comprises an actuating mechanism operable to control simultaneous activation and deactivation of the first stabilizing anchor and the second stabilizing anchor.

3. A downhole cutting tool as claimed in claim 2, wherein the actuating mechanism includes a motor driven piston and an annular sleeve, wherein the annular sleeve is connected to each anchor to allow a motor to drive the piston to displace the annular sleeve to displace the first stabilizing anchor and the second stabilizing anchor simultaneously.

4. The downhole cutting tool as claimed in claim 1, wherein the locating anchor is located upstream of the first stabilizing anchor, the second stabilizing anchor and the cutting member, wherein the second actuating mechanism is operable to actuate the locating anchor independently of the first stabilizing anchor and the second stabilizing anchor.

5. A downhole cutting tool as claimed in claim 4, wherein the second actuating mechanism includes a motor driven piston and an annular sleeve, wherein the annular sleeve is connected to the locating anchor to allow a motor to drive the piston to displace the annular sleeve to displace the locating anchor.

6. A downhole cutting tool as claimed in claim 4, wherein the first stabilizing anchor and the second stabilizing anchor are extendable from the third housing to maintain an angular position of the cutting member with respect to the tubular member by extending against the inner surface of the tubular member, wherein the locating anchor is extendable from the first housing to maintain the cutting tool at a desired depth within the tubular member and prevent vertical displacement of the cutting tool with respect to the tubular member.

7. A downhole cutting tool as claimed in claim 1, wherein the cutting member comprises a hole cutter.

8. A downhole cutting tool as claimed in claim 7, wherein the hole cutter has an annular cross-section for creating a circular cut through the wall.

9. A method comprising:

deploying a cutting tool downhole in an inner area defined by a tubular member, the cutting tool comprising a tubular body providing a housing that houses a cutting member, a first stabilizing anchor downstream of the cutting member, a second stabilizing anchor upstream of the cutting member, and a locating anchor;

extending the locating anchor to maintain the cutting tool at a desired depth within the tubular member and to prevent vertical displacement of the cutting tool with respect to the tubular member;

extending the first stabilizing anchor and the second stabilizing anchor to maintain an angular position of the cutting member with respect to the tubular member; and cutting the tubular member by extending the cutting member to the tubular member, wherein the cutting tool comprises at least an upper section comprising a first tubular and a lower section comprising a second tubular, wherein the locating anchor is housed in the upper section and wherein the first stabilizing anchor, the second stabilizing anchor and the cutting member are housed in the lower section, wherein the lower section is rotationally connected to the upper section, wherein the lower section and the upper section include a common longitudinal axis and the lower section rotates relative to the upper section about the common longitudinal axis while the upper section is rotationally stationary.

10. The method of claim 9, wherein the first stabilizing anchor and the second stabilizing anchor maintain the angular position of the cutting member with respect to the tubular member by extending against an inner surface of the tubular member.

11. The method of claim 9, further comprising:

retracting the cutting member;

retracting the first stabilizing anchor and the second stabilizing anchor;

subsequent to retracting the first stabilizing anchor and the second stabilizing anchor and while extending the locating anchor:

adjusting the angular position of the cutting member;

re-extending the first stabilizing anchor and the second stabilizing anchor to maintain an adjusted angular position of the cutting member; and performing another cut on the tubular member by extending the cutting member to the tubular member.

12. The method of claim 9, wherein extending the first stabilizing anchor and the second stabilizing anchor includes extending the first stabilizing anchor and the second stabilizing anchor simultaneously using an actuating mechanism that includes a motor driven piston and an annular sleeve connected to each of the first stabilizing anchor and the second stabilizing anchor such that a motor drives the piston to displace the annular sleeve, which displaces the first stabilizing anchor and the second stabilizing anchor simultaneously.

13. The method of claim 12, wherein the locating anchor is located upstream of the first stabilizing anchor, the second stabilizing anchor, and the cutting member and is actuated by a second actuating mechanism independently of the first stabilizing anchor and the second stabilizing anchor.

14. The method of claim 9, further comprising:

subsequent to cutting the tubular member:

retracting the cutting member into the housing;

retracting the first stabilizing anchor and the second stabilizing anchor into the housing;

subsequent to retracting the first stabilizing anchor and the second stabilizing anchor into the housing, retracting the locating anchor into the housing; and retrieving the cutting tool from the inner area of the tubular member.

15. The method of claim 9, wherein extending the locating anchor comprises:

applying a deforming action on an inner wall of the tubular member by a portion of the locating anchor that includes a serrated disc.

* * * * *